US005120583A

United States Patent [19]

Garcia

[11] Patent Number: 5,120,583

[45] Date of Patent: Jun. 9, 1992

[54] COMPOSITE FLOWER ASSEMBLY

[76] Inventor: Pedro F. Garcia, 7807 Riverside Dr., Atlanta, Ga. 30328

[21] Appl. No.: 663,707

[22] Filed: Mar. 4, 1991

[51] Int. Cl.[5] ..... A01N 3/00; A41G 1/00

[52] U.S. Cl. ..... 428/24; 156/57; 156/61

[58] Field of Search ..... 428/24, 26, 15, 17; 156/57, 61

[56] References Cited

U.S. PATENT DOCUMENTS 3,452,476 7/1969 Kise ..... 428/24 X
4,272,571 6/1981 Romero-Sierra et al. ..... 428/24
4,281,474 8/1981 Gallo ..... 428/24 X
4,808,447 2/1989 Baker ..... 428/24 X
4,943,455 7/1990 Dixon ..... 428/26

*Primary Examiner*—Henry F. Epstein
*Attorney, Agent, or Firm*—Hopkins & Thomas

[57] ABSTRACT

A composite flower assembly includes a preserved natural flower head 37, a natural receptacle 46 and a natural pedicel segment 51, the flower head being securely fastened atop an artificial calyx 66 and secured to an artificial pedical 33.

14 Claims, 3 Drawing Sheets

COMPOSITE FLOWER ASSEMBLY

TECHNICAL FIELD

The present invention generally relates to artificial flowers such as for use in floral arrangements and for other decorative purposes.

BACKGROUND OF THE INVENTION

The various flowers of the world have long been appreciated for their natural beauty. Unfortunately, the beauty of natural flowers is but short-lived. Recognizing this, various methods have been devised to preserve flowers so that they can be enjoyed for a longer time. Among these methods of preserving flowers are freeze drying, drying with a desiccant such as silica sand, plasticizing, dipping in paint, treating with chemicals such as glycerine, and the well known method of drying flowers by hanging then upside down.

While the above methods of preserving flowers are generally satisfactory for preserving the appearance of the flower itself, these methods, used alone, generally fail to provide preserved natural flowers suitable for use in floral arrangements and other decorative applications. This is so because the above methods tend to embrittle the stems (pedicels) of the flowers, thereby making them hard to work with. The brittle stems of the flowers tend to break when a floral arranger tries to use the dried flower in an arrangement or other application.

Artificial flowers have been found to be flexible enough for use by a floral arranger without breaking the stem of the artificial flower. This is so because the artificial flower can be made to have a rather resilient stem made of plastic or wire which has been wrapped with tape. However, artificial flowers in some respects are a poor substitute for natural flowers because artificial flowers can lack the delicate detail in shape, texture and color found in natural flowers. Indeed, the difficulty of producing artificial flowers which are convincing copies of natural flowers is formidable. Furthermore, if the artificial flowers are mass produced, it can be difficult to provide the artificial flowers with the random differences that occur among natural flowers on a given plant.

Accordingly, it can be seen that a need yet remains for flowers which exhibit and maintain the physical appearance of natural flowers and which also have resilient stems making the flowers easy to work with. It is to the provision of such flowers therefore that the present invention is primarily directed.

SUMMARY OF THE INVENTION

Briefly described, the present invention comprises a composite flower assembly having an artificial, semi-rigid pedicel, a preserved natural flower head (i.e.. a corolla or flower bud), and means for securing the flower head to the pedicel.

Preferably, the flower head includes a natural receptacle including a segment of the natural pedicel of the flower. A hollow coupling member is adapted to be slipped over an end of the natural pedicel segment and to be secured to an end of the artificial pedicel. An artificial calyx is secured to the coupling member and is adapted for supporting the natural flower head.

With this construction, a composite flower assembly is provided which exhibits and maintains the natural appearance of the flower head and which has a flexible, semi-rigid stem allowing the composite flower assembly to be easily manipulated as for use in a floral arrangement.

Accordingly, it is an object of the invention to provide a composite flower assembly which is durable in construction, economical in manufacture, and pleasant in appearance.

It is another object of the present invention to provide a composite flower assembly which exhibits and maintains the appearance of a natural flower head.

It is another object of the present invention to provide a composite flower assembly which can be easily manipulated for use in floral arrangements and other such decorative applications.

It is another object of the present invention to provide a composite flower assembly which is not easily damaged in handling.

It is another object of the present invention to provide a composite flower assembly in which random variations in appearance are found, as can be expected of a natural flower.

It is another object of the present invention to provide a composite flower assembly which can be easily constructed to include a wide array of desired flower heads.

Other objects, features and advantages of the present invention will become apparent upon reading the following specification in conjunction with the accompanying drawing figures.

BRIEF DESCRIPTION OF THE DRAWING FIGURES

DETAILED DESCRIPTION

Figure 1:
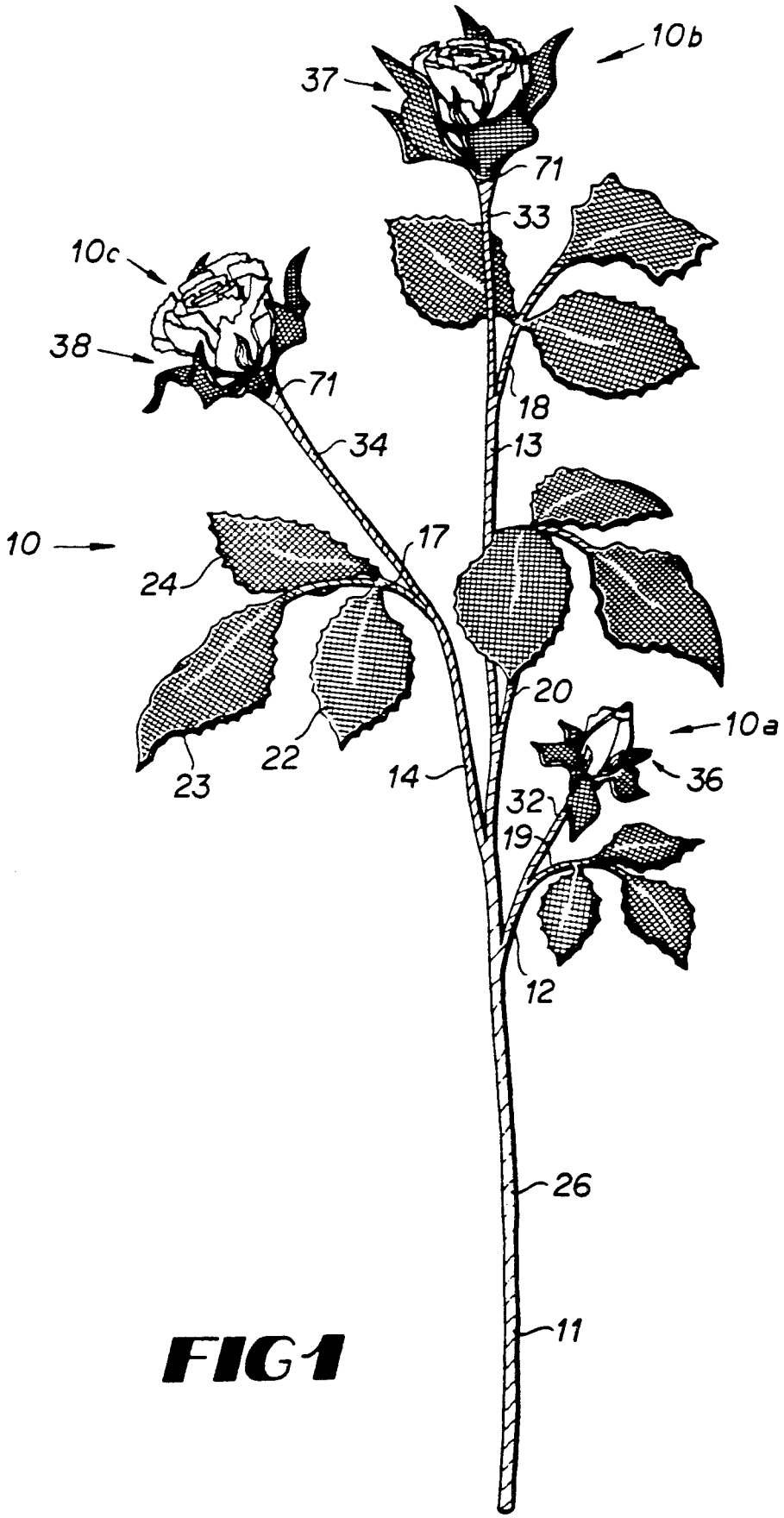
FIG. 1 is a perspective illustration of a composite plant including several composite flower assemblies according to the present invention.
Figure 2:
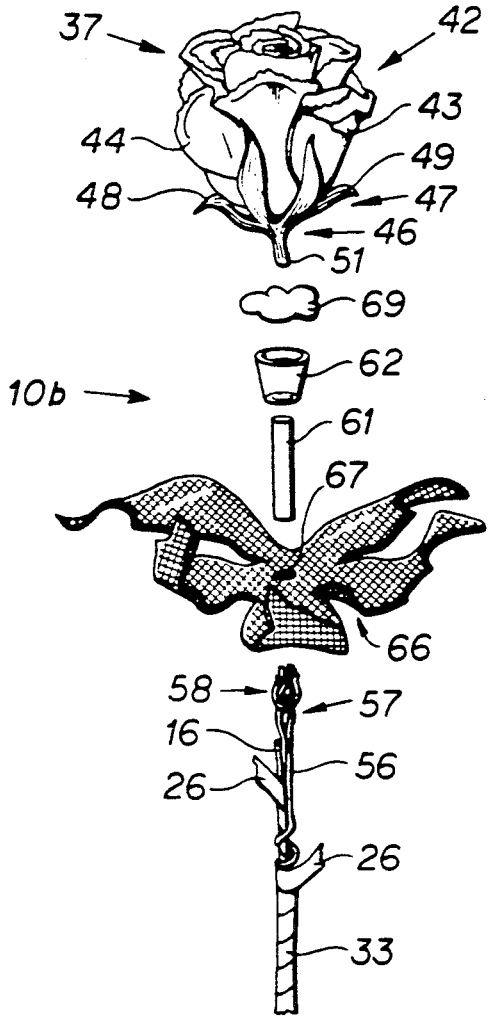
FIG. 2 is a perspective, exploded, schematic illustration of a portion of a composite flower assembly of FIG. 1.
Figure 3:
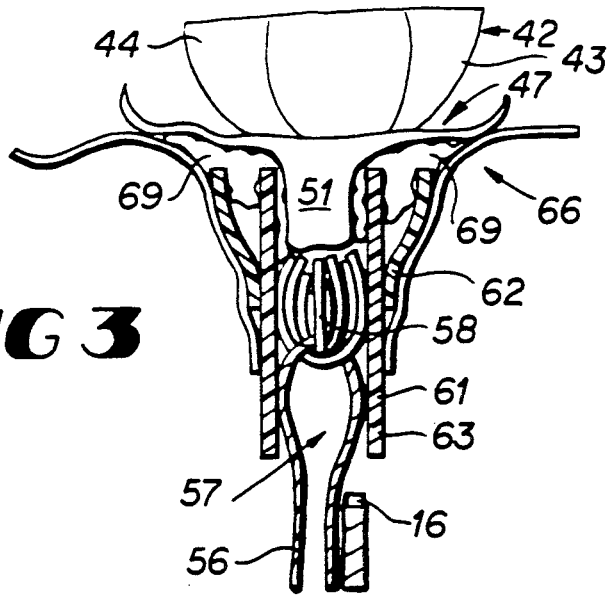
FIG. 3 is a schematic, sectional illustration of a portion of the composite flower assembly of FIG. 2.

Referring now in more detail to the drawing figures, in which like reference numerals represent like parts throughout the several views, FIGS. 1–3 show a composite flower plant 10 including composite flower assemblies 10*a*, 10*b*, and 10*c*, in a preferred form of the invention. In considering the illustrative embodiment disclosed herein, it is to be understood that a composite flower assembly, such as composite flower assembly 10*b*, can be produced as a single component for use in floral arrangements or other applications. On the other hand, the composite flower assembly can be incorporated into a unitary plant, such as composite flower plant 10, as the need arises. A composite rose plant is depicted in the drawings, but other types of flowers can be used as desired.

Composite flower plant 10 is seen to comprise a main stem or trunk 11 supporting first, second, and third smaller stems 12, 13, and 14. The stems 11–14 are artificial and can be made in accordance with any number of well-known construction techniques. For example, stems 11–14 can be made of molded plastic or can be made of metal wire surrounded by a covering of green florist's tape. In the embodiment disclosed herein, stem 11 has a central core made up of three metal wires, each wrapped in insulation, for example, wire 16 shown in FIG. 3 is wrapped with a cotton fabric. A plurality of relatively heavy gauge wires can be used to construct the main stem and the wires separated along their length to form the smaller stems 12–14. Furthermore, smaller gauge wire can be used to construct leaf stems terminating at the stems 12–14, such as leaf stems 17–20. These leaf stems support a number of individual leaves such as leaves 22, 23 and 24 supported on leaf stem 17. The leaves can be made of any number of well-known materials, such as injection-molded plastic, silk, or other fabric material suitable for the particular purpose at hand.

An important advantage of using artificial stems and leaves as compared with preserved natural stems and leaves is that the artificial stems and leaves can be readily manipulated into a particular desired shape or orientation. This is particularly important in creating custom plants or floral arrangements. In this regard it is considered that stems having a wire core construction are preferred over the use of plastic stems in that wire core stems are better able to retain a desired shape for a long period of time after being bent into that shape. Of course, both plastic molded stems and wire core stems are much more durable and less brittle than preserved natural stems which tend to snap off rather easily.

The various stems can be wrapped with a green-colored florist's tape 26 to give the stems a natural appearance and to conceal the fact that the stems are made of wire. Furthermore, the leaves can be colored, textured and shaped to resemble natural leaves of the particular plant depicted, as is well-known in the art.

A portion of each stem 12–14 that extends above the leaf stems 17, 18 and 19 comprises a flower stem or artificial pedicel (or flower stalk), such as artificial pedicels 32, 33 and 34. Artificial pedicel 32 supports a flower head 36 in the form of a bud, while artificial pedicels 33 and 34 support flower heads 37 and 38 in the form of opened flowers each having a corolla.

FIG. 1 depicts a composite flower plant 10 incorporating therein a number of composite flower assemblies 10*a*, 10*b*, and 10*c*. Turning now to FIG. 2, the structure of the individual flower assemblies, such as flower assembly 10*b* is shown in detail.

Composite flower assembly 10*b* includes a natural flower head 37 which has been preserved in any of a number of well-known techniques as described above. Flower head 37 is seen to include a corolla 42 comprised of individual petals, such as petals 43 and 44. Alternatively, flower head 37 can include a flower bud such as flower head 36 of composite flower assembly 10*a*. The flower head's naturally occurring receptacle 46 remains attached to the flower head and provides support and structural integrity therefor. The flower head preferably includes a natural calyx 47 made up of individual sepals, such as sepals 48 and 49. Attached to and descending from the lowermost portion of the receptacle 46 is a small segment 51 of the natural pedicel of the flower. This natural pedicel segment 51 should be rather short to prevent it from being easily snapped off, owing to the rather brittle nature of the preserved natural pedicel.

Artificial pedicel 33 includes an insulated wire core 16 as previously described and is wrapped by green-colored florist's tape 26. A smaller securing wire 56 is folded over to form an eyelet 57 extending beyond the end of insulated wire core 16, with most of the length of the securing wire 56 being attached to the artificial pedicel 33 by wrapping the securing wire around the insulated wire core 16 and subsequently covering these with an additional layer of green-colored florist's tape 26. A number of coarse, short threads are looped through the eyelet and stiffened with wax to form an elongated ball of thread 58.

As best shown in FIG. 3, eyelet 57 and ball of thread 58 are received within a hollow tubular coupling member 61. Tubular coupling member 61 also receives therein natural pedicel segment 51 of the flower head 37. Thus, the coupling member 61 couples the flower head 37 to the artificial pedicel 33. Tubular coupling member 61 is received within a hollow, conical member 62 which is of a shorter length than the coupling member 61 so that a lower portion 63 of tubular coupling member 61 extends out of the bottom of conical member 62. An artificial calyx 66 is glued to the outside surface of conical member 62, as shown in FIG. 3. Artificial calyx 66 includes a central opening 67 through which lower portion 63 of tubular coupling member 61 extends, as shown in FIG. 2. A quantity of silicone glue 69 adheres natural pedicel segment 51 and the underside of receptacle 46 to the tubular coupling member 61 and to the upper surface of the artificial calyx 66. The silicone glue 69 also tends to stabilize the position of the upper portion of tubular coupling member 61 with respect to the conical member 62 to prevent it from wobbling about. Silicone glue or some other type of flexible adhesive calking is preferred in order to provide some give or compliance to the attachment to avoid unwanted breakage of the various elements. The artificial calyx 66 is rather stiff and the glue interposed between the artificial calyx and the natural calyx 47 tends to support and stabilize the flower head upon the artificial calyx 66. As shown in FIG. 1, a small quantity of green-colored florist's tape 71 is used to conceal the junction between the flower head and its associated artificial pedicel.

ASSEMBLY

Figure 4C:
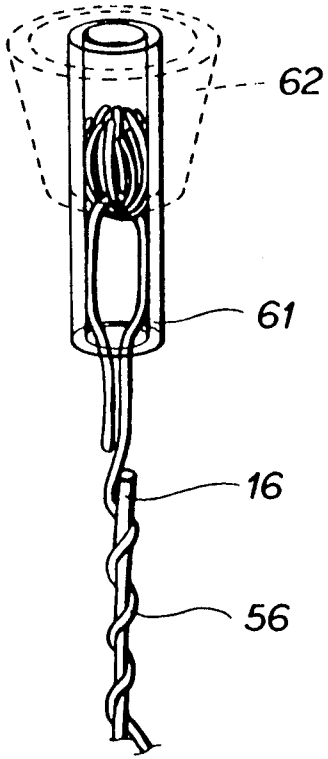
FIGS. 4A–4C are schematic, perspective illustrations of a portion of the composite flower assembly of FIG. 3, depicting some steps of an assembly process for constructing the composite flower assembly.

The composite flower assembly can be assembled as follows. After preserving a natural flower head or obtaining a preserved natural flower head, the securing wire 56, including the eyelet 57 carrying the ball of waxed thread 58, is threaded into the tubular coupling member 61. This threading is accomplished by directing the ends or legs 72 and 73 of securing wire 56 into the opening formed in the tubular coupling member 61 in the direction of direction arrow 76, as shown in FIG. 4A. In FIG. 4A, the artificial calyx 66 is removed for clarity of illustration, while the conical member 62 is shown in dash lines to depict the orientation of coupling member 61. As the waxed ball of thread 58 is drawn into the interior of the tubular coupling member 61, the stiffness of the threads, both the natural stiffness of the threads and the stiffness imparted by the wax, creates a snug fit of the ball of thread within the passageway of the tubular coupling member. The securing wire 56 is pulled through until the eyelet 57 and the ball of thread 58 are in a lower portion of the tubular coupling member 61, as depicted in FIGS. 3 and 4B.

Figure 4B:
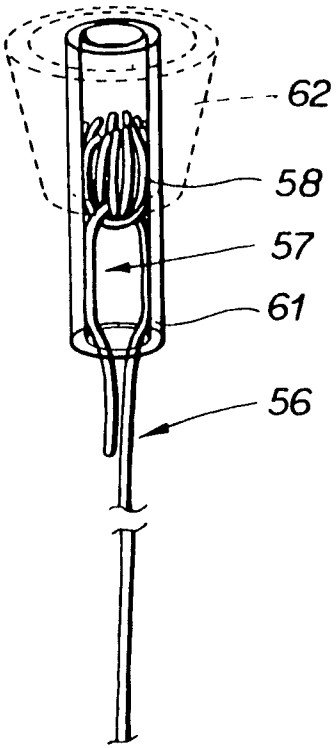
Figure 4A:
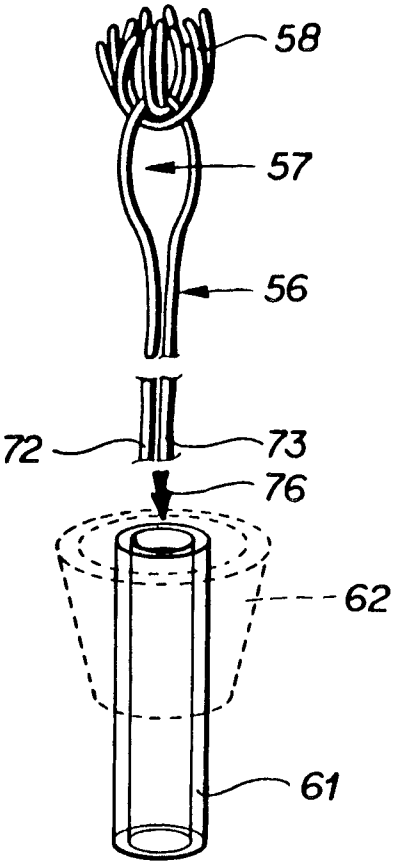

With the securing wire now securely attached to the coupling member 61 by means of the frictional fit of the ball of thread 58 within the tubular coupling member 61, the securing wire 56 depends downwardly from the bottom of the tubular coupling member 61 as shown in FIG. 4B. The securing wire 56 is now ready to be secured to the artificial pedicel 33. This is accomplished by wrapping the securing wire 56 helically about the insulated wire core 16 as depicted in FIG. 4C. The securing wire 61 and the insulated core 16 are then wrapped with green-colored florist's tape to strengthen and conceal this connection. Next, glue 69 is positioned about the upper portion of the tubular coupling member 61 and the conical member 62, and the flower head 37 is then lowered into the artificial calyx 66, with the natural pedicel segment 51 extending into tubular coupling member 61.

With this construction, the composite flower assembly exhibits and maintains the natural appearance of the flower head and is easily manipulated as for use in a floral arrangement. In such use, the composite flower assembly is much more durable than a flower with a preserved natural pedicel and the composite flower assembly is not as easily damaged when handled. By using preserved natural flower heads, a composite flower plant, including a number of composite flower assemblies, does not suffer from having identical flower heads; rather the flower heads, being preserved natural flower heads, exhibit random variations in appearance. The invention lends itself to being used to quickly produce custom arrangements of a wide variety of flowers, by using generic artificial pedicels and attaching the desired flower head thereto as the need arises. A composite flower assembly according to the invention is both economical in manufacture and pleasant in appearance.

While the invention has been disclosed in a preferred form, it will be obvious to those skilled in the art that many additions, deletions and modifications of the present invention are possible. For example, it is possible to replace the separate tubular coupling member 61, conical member 62 and artificial calyx with one integral element, thereby minimizing assembly efforts. Also, other means of attaching the artificial pedicel 32 to the artificial calyx 66 are possible, such as forming a cavity in a lower portion of the artificial calyx 66 and using a strong adhesive to secure the end of the artificial pedicel in the cavity. Also, it is possible to construct the various components so that they snap together, thereby obviating the need for adhesives. Such and other modifications are considered to fall within the spirit and scope of the appended claims.

I claim:

1. A composite flower assembly comprising: an artificial, semi-rigid pedicel; a preserved natural flower head having a receptacle and a pedicel segment; and coupling means defining a recess therein for receiving said preserved natural pedicel segment in said recess for connecting said preserved natural flower head to said artificial semi-rigid pedicel.

2. A composite flower assembly as claimed in claim 1 further comprising an artificial calyx adjacent said preserved natural flower head.

3. A composite flower assembly as claimed in claim 1 wherein said coupling means for connecting comprises a tubular coupling member disposed between said preserved natural pedicel segment of said preserved natural flower head and said artificial pedicel.

4. A composite flower assembly as claimed in claim 3 wherein said coupling member is secured to said preserved natural pedicel segment with adhesive.

5. A composite flower assembly as claimed in claim 3 further comprising an elongate member for attaching said hollow coupling member to said artificial pedicel.

6. A composite flower assembly as claimed in claim 5 wherein said hollow coupling member defines a passageway therethrough for receiving a first end of said elongate member, and further comprising means for securing said first end of said elongate member within said passageway.

7. A composite flower assembly as claimed in claim 1 wherein said natural flower head comprises a corolla.

8. A composite flower assembly as claimed in claim 1 wherein said natural flower head comprises a bud.

9. A composite flower assembly as claimed in claim 1 further comprising an artificial calyx secured to said preserved natural receptacle.

10. A composite flower assembly as claimed in claim 1 wherein said artificial pedicel comprises a metal wire core.

11. A composite flower assembly as claimed in claim 1 further comprising one or more artificial leaves mounted adjacent said artificial pedicel.

12. A composite flower assembly comprising;

an artificial, semi-rigid pedicel;

a preserved natural flower including a preserved natural receptacle and a preserved natural pedicel segment; and means for connecting said preserved natural pedicel segment of said preserved natural flower to said artificial pedicel comprising a coupling member having a recess formed therein adapted for engaging said preserved natural pedicel segment of said preserved natural flower.

13. A composite flower assembly as claimed in claim 12 further comprising an artificial calyx intermediate of and secured to said coupling member and said preserved natural receptacle.

14. A composite flower assembly as claimed in claim 12 further comprising at least one artificial leaf mounted adjacent said artificial pedicel.

* * * * *